US006138427A

United States Patent [19]

Houghton

[11] Patent Number: 6,138,427

[45] Date of Patent: Oct. 31, 2000

[54] MOMENT RESISTING, BEAM-TO-COLUMN CONNECTION

[76] Inventor: David L. Houghton, Houghton, Myers and Nelson Baytower Corporate Centre 15901 Hawthorne Blvd., Ste. 400, Lawndale, Calif. 90260

[21] Appl. No.: 09/141,714

[22] Filed: Aug. 28, 1998

[51] Int. Cl.[7] ..... E04B 1/19; E04B 1/38

[52] U.S. Cl. ..... 52/655.1; 52/236.3; 52/653.1

[58] Field of Search ..... 52/236.3, 236.6, 52/236.9, 167.3, 283, 289, 655.1

[56] References Cited

U.S. PATENT DOCUMENTS

| | | | |
|---|---|---|---|
| 574,434 | 1/1897 | Keithley . | |
| 1,883,376 | 10/1932 | Hilpert . | |
| 2,675,895 | 4/1954 | Loewenstein | 52/236.3 |
| 3,593,477 | 7/1971 | Briggs | 52/283 |
| 3,952,472 | 4/1976 | Boehmig . | |
| 4,476,662 | 10/1984 | Fisher . | |
| 5,660,017 | 8/1997 | Houghton . | |

FOREIGN PATENT DOCUMENTS

| | | |
|---|---|---|
| 771849 | 11/1967 | Canada . |
| 619608 | 7/1978 | U.S.S.R. . |

*Primary Examiner*—Michael Safavi
*Attorney, Agent, or Firm*—L. Lee Humphries

[57] ABSTRACT

A moment resisting, beam-to-column connection, comprising two gusset plates attached to a column and extending along the sides of a beam and having connecting elements, for example, angle irons, which attach the gusset plates to the beam. The connecting elements are bolted, riveted or welded to the beam along its longitudinal direction and to the gusset plates.

32 Claims, 10 Drawing Sheets

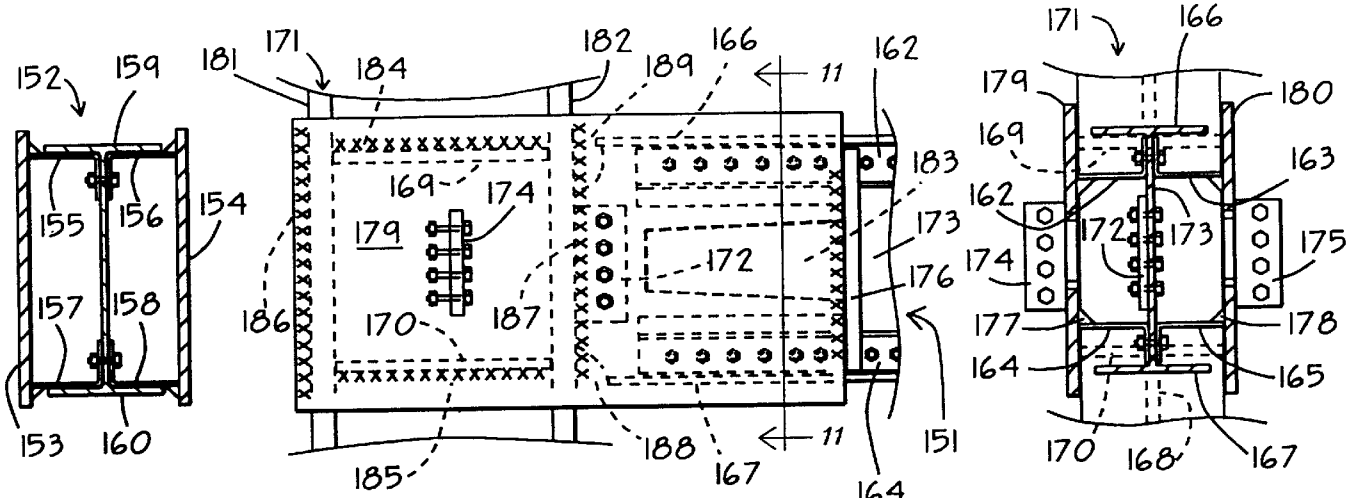
FIG. 10
FIG. 11
FIG. 12
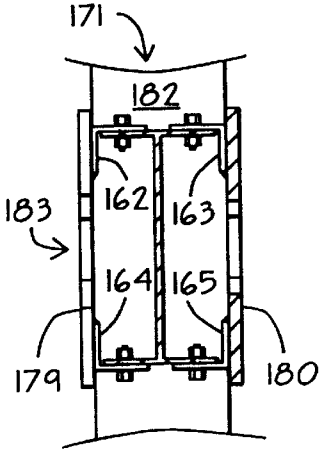
FIG 15
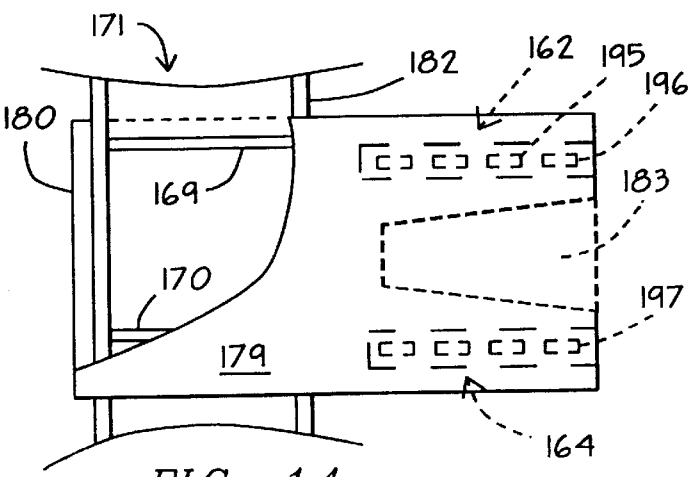
FIG. 14
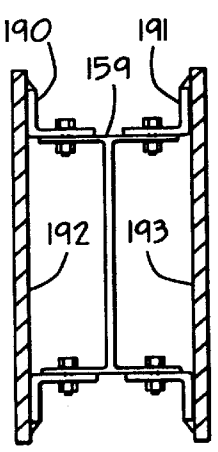
FIG. 13

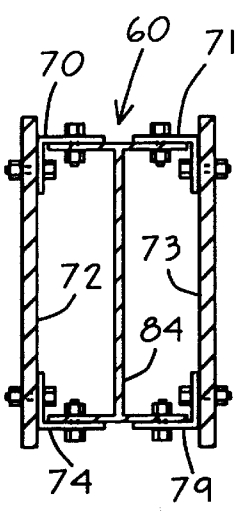
FIG. 17
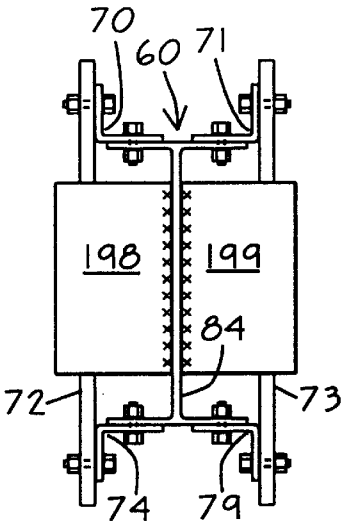
FIG. 18
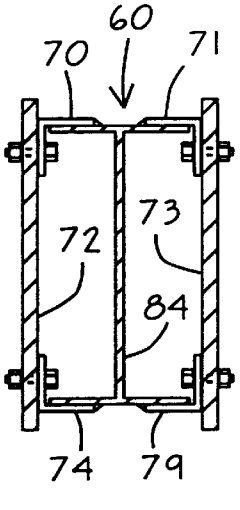
FIG. 19
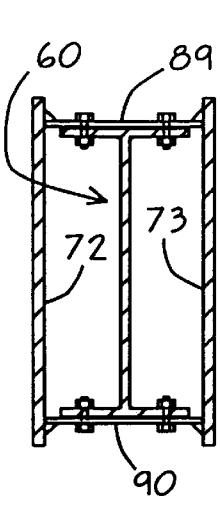
FIG. 20
FIG. 21
FIG. 22
FIG. 23
FIG. 24

MOMENT RESISTING, BEAM-TO-COLUMN CONNECTION

This invention is a moment resisting, beam-to-column connection for use in construction of single and multiple story buildings having a framework of structural steel. It is primarily useful in retrofit construction to strengthen or restore a building, wherein it is found that substantial improvement is needed in the beam-to-column connections, and, particularly, where there is limited access to beam or column flanges because of walls, roofs or floors being already in place. However, it may be used in original construction.

This application relates to U.S. Pat. No. 5,660,017, entitled Steel Moment Resisting Frame Beam-To-Column Connections, issued Aug. 26, 1997, invented by the same inventor as herein.

BACKGROUND OF THE INVENTION

It has been found that most of the energy of a seismic event is absorbed and dissipated, in a building having a structural steel framework, in the beam-to-column connections of the building.

The prior art teaches numerous connections of beams to columns. Experience in recent earthquakes has taught that such traditional connections must be improved.

Previously, the most common beam-to-column connection has been one in which the beam has the ends of its top and bottom flanges welded to one flange, or face, of the column by large, highly-restrained, full-penetration, single-bevel groove welds. Vertical loads, that is, the weight of the floors and on the floors, are commonly carried by vertical shear tabs. Each such shear tab is vertically disposed and is welded to the face of the column and bolted or welded to the web of the beam, at the end of the beam at the column, using high-strength bolts.

There has been partial or complete failure of the highly-restrained welds between the beam flange and the column flange, either by a crack in the weld itself or a crack along the heat affected zone of the column flange, pulling a divot of column steel from the face of the column flange. The origination of the crack is normally at the narrow root of the groove weld profile, which is inherently subject to slag inclusions during the field welding process. These inclusions act as stress risers that initiate cracking during the impactive load from an earthquake.

Stress risers are also created by the backer bar used to bridge the root gap before making the weld. The backer bar is commonly tack welded in place below each beam flange and not removed. In addition, these failures between the beam flange and column flange have resulted in shear failure of the high strength bolts connecting the shear tabs to the web of the beam for the support of the gravity loads.

In other instances, the crack again originates at the root of the groove weld, but enters the column flange and propagates through the full thickness and width of the flange and into the column web.

Subsequent attempts by the building industry to improve beam-to-column connections still rely on post-yield straining of large, highly-restrained, full-penetration, single-bevel groove welds performed under field conditions. Such highly-restrained welds do not provide a reliable mechanism for dissipation of earthquake energy, or other large forces, and can lead to brittle fracture of the weld and the column. Such brittle fracture is in violation of the moment-resisting design philosophy of the Uniform Building Code.

It is desirable to achieve greater strength in such beam-to-column connections in order to make buildings less vulnerable to earthquakes, explosions, tornadoes or other large scale, damaging occurrences. The invention herein is particularly useful in upgrading and strengthening pre-engineered steel frame buildings for improved blast resistance.

In the case of earthquakes, greater strength is particularly desirable in resisting sizeable moments in both the lateral and the vertical plane. That is, the beams in a building, in an earthquake, are caused to move both horizontally and vertically, placing severe stresses on the locations where the beams are connected to the columns.

Engineering analysis, design and testing have determined that prior steel frame techniques can be substantially improved by strengthening the beam-to-column connection in a way which better resists and withstands the sizeable moments which are placed upon the beam.

It is a goal, therefore, to increase lateral and vertical stability as well increase the vertical load-carrying capability. The invention herein provides such capability, providing both a lateral and vertical moment resisting connection, and increased, vertical load-carrying capability. Further, the invention complies with the emergency code provisions issued by the International Conference of Building Officials.

Consequently, the improved design of the invention is capable of carrying greater loads and capable of withstanding greater earthquakes and other calamities which may place extreme strain on a structure.

Another feature of the invention is that it is cost-effective. By providing stronger beam-to-column connections, lighter steel beams and columns can be used, while still providing greater strength in the beam-to-column connections and, also, in the overall structure of the building, compared to prior structures.

The beam-to-column connection invention herein is may be made in the shop under controlled conditions and placed in a retrofit construction. Shop fabrication provides for better quality construction of a beam-to-column connection by reason of better control of the manufacturing process and easier access to and handling of all parts of the connection. The invention effectively makes use of fillet welds, which are better made under shop conditions, although it can suitably be made in the field. Splice plates are commonly used in the field to insert column sections and beam sections in their selected place in a structure. Such splice connections are located at structural points of reduced flexural stress. That is, the splice connections are located at some distance from the beam-to-column connection.

However, the invention herein is particularly effective when used in field retrofit modification wherein beams and columns require strengthening in place and wherein beam-to-column connections are to be strengthened in place, in structures having floors, walls and roofs already in place and attached to the beams and columns.

However, the invention herein may be used in new construction and may be constructed in place and on site.

BRIEF SUMMARY OF THE INVENTION

The present invention is a beam-to-column structural joint connection having two gusset plates fixedly attached on opposing sides of a column and a beam, and connecting elements, connecting gusset plates, beam and column together, similar to that taught in U.S. Pat. No. 5,660,017, invented by me. All elements are likely to be what is known as A-36 specification, structural steel, except for the bolts and washers. Aluminum and other high-strength metals might be found suitable under some circumstances. For example, the gusset plates herein might be made of high-strength aluminum.

The gusset plates extend from the column along opposing sides of the beam. U.S. Pat. No. 5,660,017, teaches use of two gusset plates fixedly attached on opposing sides of a column and gusset plates which extend from the column along opposing sides of the beam. In the patent, the gusset plates are connected to the beam by flange cover plates which are welded to the flanges of the beam and welded to the gusset plates. Alternatively, in the case of a wide-flanged beam, the flanges of the beam are welded directly to the gusset plates. Such gusset plate technology is eminently successful.

It was found, however, that in many existing structures, needing upgrading and strengthening, there is not ready access to beam and column flanges. Floors, walls and roofs would have to be torn away and replaced after retrofit using gusset plate connections. Then, it was determined by engineering analysis that angle irons could be attached to the more-accessible webs of the beams and the columns and advantage then taken of gusset plate technology. That is, the angle irons, which strengthen beam and column, when welded to gusset plates, provide excellent load-carrying, moment resisting, beam-to-column connections. Some beams, columns and their moment resisting connections can be strengthened to three times their original strength, to provide substantially increased blast resistance.

Further, it was found that by making use of a substantial amount of bolting, a somewhat different mechanism was provided, that of slippage between bolted parts in the direction of flexural load on the beam. Such slippage was determined capable of dissipating substantial energy in the event of seismic overload, tornadoes or other severe stress being placed on the building.

In the preferred embodiment of the instant invention of beam-to-column connection, gusset plate technology is still used. That is, two gusset plates are attached in face-to-face relationship on opposing sides of a column. The beam is an I-beam, having an upper and lower flange and a vertical web connected between them. The gusset plates extend from the column along the sides of the beam. Two angle irons are disposed opposite each other, extending along the web of the beam, near the upper flange of the beam. Bolts extend through one angle iron, the web of the beam and then through the other angle iron. Another two angle irons are similarly placed near the lower flange of the beam. The angle irons are welded to the gusset plates.

The structural connection of this invention has been found to take advantage of gusset plate technology to increase the strength and ductility of the beam-to-column connection. Contrary to prior beam-to-column structural joint connections, the invention, by taking advantage of gusset plate technology, does not rely heavily on post-yield straining of the joint.

The invention is particularly useful in retrofit circumstances wherein the column and beam are already in place and the beam-to-column connection must be improved. The preferred embodiment of the invention connects the gusset plates to the web of the beam and, therefore, relies less on the strength of the flanges of the beam for strength in the joint connection.

In bolting the angle irons to the beam or column, oversize bolt holes facilitate construction and provide energy dissipating mechanisms through bolt slippage at high stress levels. The invention utilizes less-restrained, inherently-ductile fabrication by welds and bolt lines which run in the greatest direction of strain, by gusset plates which connect the beams to the columns and by removal of prior, highly-restrained, groove welds between beam flange and column flange. Bolts which are used in most steel construction and in this invention are most commonly referred to as A325F or A425F.

Vertical stability, stability in the vertical plane, is achieved by the great strength of the gusset plates and their strong connection to both column and beam. The joint connections of the present invention can be designed to withstand a load that is greater than the plastic moment capacity of the connected beam.

Lateral stability, stability in the horizontal plane, is achieved in the instant invention, by the structural frame of the building in such horizontal plane. That is, the beams connecting each column to its adjoining columns and beams provide the primary resistance to moments in the horizontal plane.

It was found that some existing structures do not lend themselves well to the invention using gusset plate technology set forth in U.S. Pat. No. 5,660,017, invented by me. If a floor has been laid on a beam, or a wall has been built against a column, in existing structure, the flanges of the beam and the column may not be easily accessible, but the webs are. Consequently, attaching angle irons to the web then allows use of the gusset plate technology by welding the angle irons to the gusset plates.

Bolting such angle irons to the readily-accessible web is very efficient and time-saving in the retrofitting of structural joint connections. A single bolt passes through an angle iron, the web of the beam and through another angle iron. Likewise, angle irons may be bolted to the web of the column and welded to the gusset plates, if the retrofitting is desired to bypass the flanges of the column, in order to achieve greater strength in the structural joint connection or, because of prior structure, it just may be easier to have access to work on the web of the column than to try to get to the flanges of the column.

Of course, it is to be appreciated that rivets might be used in place of the bolts, in the invention herein, but bolts are preferred for use in such structural joints. The term "fastener" or "fasteners" herein is intended to include either or both bolts (and their associated nuts) and rivets. Such "fasteners" allow slippage and provide an energy dissipating mechanism. "Fastened" is intended to include attachment by use of "fasteners". "Attached" herein, includes "fastened", (bolted or riveted), and "welded".

Another embodiment of the invention is one in which the angle irons are bolted or riveted to the flanges of the beam, rather than the web, and the angle irons are welded to the gusset plates. Such structures act to build up the width of the flange of a beam. While effective, such structure is still not as effective as the structure set forth in my U.S. Pat. No. 5,660,017, in which plates are welded to both gusset plates and flanges of a beam.

Various modifications of the invention are possible, using angle irons connected to the gusset plates and to the beam.

In still further, alternative embodiments of the invention, plate means, such as cover plates, are bolted or riveted to the flanges of the beam and welded to the gusset plates. Thus, plate means, that is, the cover plates, attach the gusset plates to the beam. Hybrid systems may use angle irons to attach gusset plates to the beam as well as cover plates to attach gusset plates to the beam.

It is, therefore, an object of this invention to provide an improved, moment resisting, beam-to-column connection using gusset plate technology.

Another object of this invention is to provide a beam-to-column connection particularly adapted for use in retrofit, or replacement, circumstances, particularly wherein beam or column webs are more accessible than their flanges.

A further object of this invention is to provide a beam-to-column joint connection which provides an energy dissipating mechanism through bolt slippage at high stress levels.

Still another object of this invention is to widely distribute stress of seismic and other large loads, in a beam-to-column connection, without heavy reliance on flange to flange weld connections.

A still further object of the invention is to provide alternative, suitable, structural joint connection means between gusset plates and beams and columns.

Still another object of the invention is to provide a structural beam-to-column structural joint connection which eliminates post-yield straining of large highly-restrained, full-penetration groove welds.

Further objects and features will become apparent from the following drawings and description.

BRIEF DESCRIPTION OF THE DRAWINGS

FIG. 5 also shows how a stub beam may be spliced to a continuation beam.

FIG. 10 is a cross-section of a beam in connection with gusset plates, showing the angle irons close to the flanges of the beam.

FIG. 11 is a cross-section of a beam to gusset plate connection, showing the angle irons spaced a substantial distance from the flanges of the beam, and reversed in their disposition from that shown in FIG. 10. Hidden lines show the column web and horizontal shear plates within the column.

FIG. 12 is a side view of FIG. 11, showing the gusset plates having cut-outs, and, in hidden lines, the horizontal shear plates, fillet welds to such plates and column flanges, shear tab plate and angle irons bolted to the web of the beam.

FIG. 13 is a cross-section of a beam to gusset plate connection, showing angle irons bolted to the flanges of the beam and welded to the gusset plates.

FIG. 14 is a side view of a beam-to-column connection, having the near gusset plate broken away, illustrating cut-outs in the gusset plates, showing horizontal shear plates within the column and in dotted lines an alternative means of welding the angle irons to the gusset plates, using plug welding through the holes.

FIG. 15 is a cross-section of a beam to gusset plate connection which illustrates a reversal of angle irons, from that shown in FIG. 13, in which the angle irons are bolted to the flanges of the beam and welded to the gusset plates.

FIG. 17 is a cross-section of a beam to gusset plate connection in which angle irons are bolted to the gusset plates and, also, bolted to the flanges of beam.

FIG. 18 is a cross-section of a beam to gusset plate connection similar to that of FIG. 17, but reversed in position, in which the angle irons are bolted to the gusset plates and to the flanges of beam.

FIG. 19 is a cross-section of a beam to gusset plate connection in which the angle irons are bolted to the gusset plates and welded to the outer sides of the flanges of the beam of beam.

FIG. 20 is a cross-section of a beam to gusset plate connection in which a connection plate is bolted to the upper flange of the beam and welded to the gusset plates, and a connection plate is bolted to the lower flange of the beam and welded to the gusset plates. The connection plates are on the outer sides of the flanges of the beam.

FIG. 21 is a cross-section of a beam to gusset plate connection in which two connection plates are bolted to the upper flange of the beam and welded to the gusset plates, and two connection plates are bolted to the lower flange of the beam and welded to the gusset plates.

FIG. 22 is a cross-section of a beam to gusset plate connection, similar to that shown in FIG. 21, in which two connection plates are riveted to the upper flange of the beam on the underside of the flange and two connection plates are riveted to the lower flange of the beam on the underside of the flange, and all the connection plates are welded to the gusset plates.

FIG. 23 is a cross-section of a beam to gusset plate connection in which a connection plate is welded to the upper flange of the beam and the gusset plates and angle irons are connected to the web of the beam near the lower flange of the beam and welded to the gusset plates.

FIG. 24 is a cross-section of a beam to gusset plate connection in which two connection plates are welded to the upper flange and two angle irons are bolt to the web of the beam, at the lower flange, and welded to the gusset plates.

DETAILED DESCRIPTION

Figure 1:
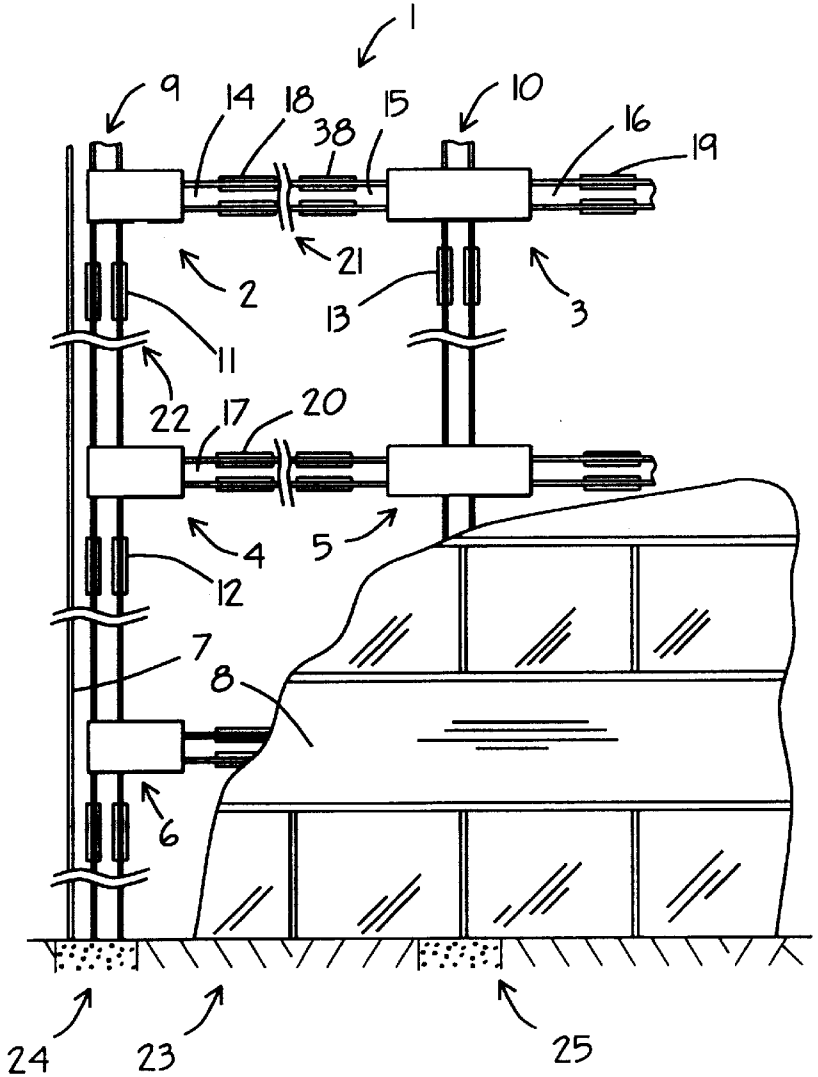
FIG. 1 is a partial, elevation view of the structural steel framework of a building, showing a number of moment resisting, beam-to-column connections and a side curtain wall and, in break-away, an exterior, front curtain wall, which would be attached to the steel structure.

FIG. 1 is a partial, elevation view of the structural steel framework 1 of a building, showing a number of moment resisting, beam-to-column structural joint connections 2, 3, 4, 5 and 6 and a side curtain wall 7 and, in break-away, an exterior, front curtain wall 8, which walls are attached to the steel structure as commonly known in the practice of steel construction of buildings. Columns 9 and 10 may be continuous or may be spliced either as shown by column splice plates 11, 12 and 13, or by being fully welded in a butt joint. Beams, such as beams 14, 15, 16 and 17 may also be continuous or be spliced to continuation beams or beams attached to another column either as shown by splice plates 18, 38, 19 and 20, or by being fully welded in a butt joint. Broken lines such as broken lines 21 and 22 show that the distances between columns and beams are greater than the proportions shown, relative to the sizes shown for structural joint connections 2, 3, 4 and 5.

The framework 1 of the building is shown resting on the ground 23 and appropriate foundations 24 and 25. Of course, other forms of ground construction, basement and underground construction may carry such framework 1.

It is noted that structural joint connection 2 is located at a corner of the building and only one beam 14 is shown, in this FIG. 1, connected to column 9 by structural joint connection 2. On the other hand, structural joint connection 3 shows two beams 15 and 16 connected to column 10.

Figure 2:
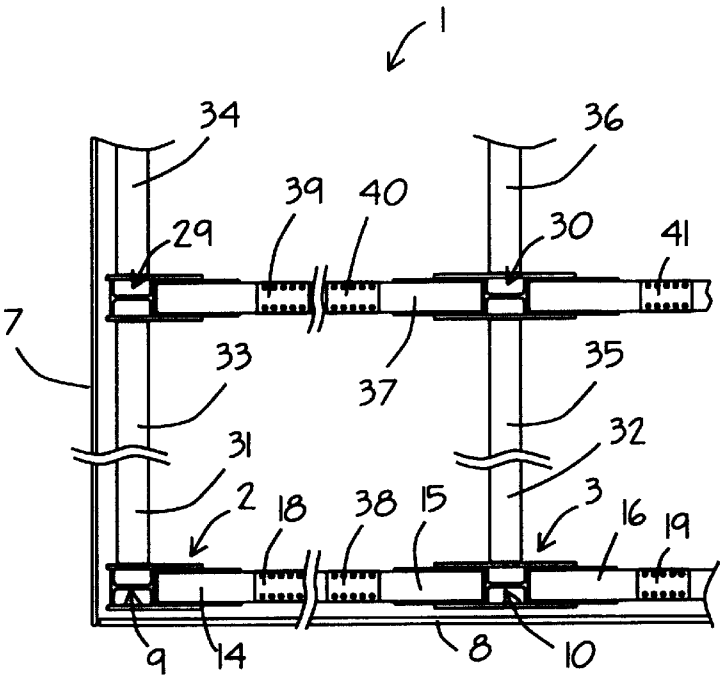
FIG. 2 is a partial, top view of the structural steel framework of a building, showing the interconnections of the columns to beams and gusset plates.

FIG. 2 is a partial, top view of the structural steel framework 1 of the building, showing the interconnections of the columns 9, 10, 29 and 30 to beams 31–37. As may be seen, columns 9 and 10 are "H" columns. Other columns may be used, particularly box columns. Splice plates 18 and 19 are also shown, together with other splice plates 38, 39, 40 and 41. Side curtain wall 7 and front, exterior curtain wall 8 are also shown.

Figure 3:
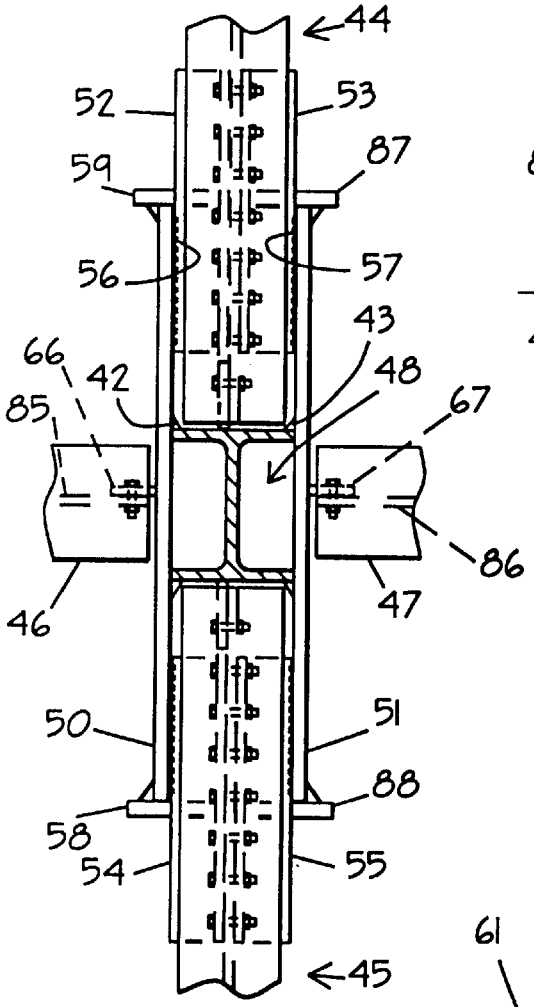
FIG. 3 is a top view of the structural joint of the invention, illustrating four beams connected to a column.

FIG. 3 is a top view of the structural joint of the invention, illustrating four beams 44, 45, 46 and 47 connected to a column 48. As can be seen, beams are connected to all four sides of column 48. Gusset plates 50 and 51 are welded to column 48, as shown, for example, by fillet welds 42 and 43. Similarly, gusset plates 50 and 51 are connected to the webs of beams 46 and 47 by shear tab plates 66 and 67, being bolted, riveted or welded to those webs, and welded to gusset plates 50 and 51. Connection means, such as angle irons 52, 53, 54 and 55, extend out from under the flanges of beams 44 and 45 and are welded to gusset plates 50 and 51 as shown, for example, at fillet welds 56 and 57.

As can be seen in FIG. 3, the angle irons 52–55 are bolted, or they may be riveted, to beams 44 and 45 along their longitudinal direction for substantially the distance the gusset plates extend along the sides of the beam. This allows slight slippage in the direction of the flexural load of the beam under conditions of extreme stress and provides an energy dissipating mechanism not found in prior art structural joint designs, in conjunction with usage of gusset plates.

FIG. 3 also shows the vertical shear plates 58 and 88 which are welded, preferably by fillet welds, as shown, to gusset plates 50 and 51 and to the web of beam 45. Such plates are very important in the transfer of vertical shear forces from the beam to the gusset plates. Occasionally, by critical engineering analysis, vertical shear plates may be found unnecessary. "Vertical" shear plates is intended to include not only strictly "vertical" shear plates, but, also, those circumstances in which the shear plates are directed in a downward direction, but not strictly "vertical". Similarly to vertical shear plates 58 and 88, vertical shear plates 59 and 87 are fillet welded, as shown, to gusset plates 50 and 51 and to the web of beam 44.

Figure 4:
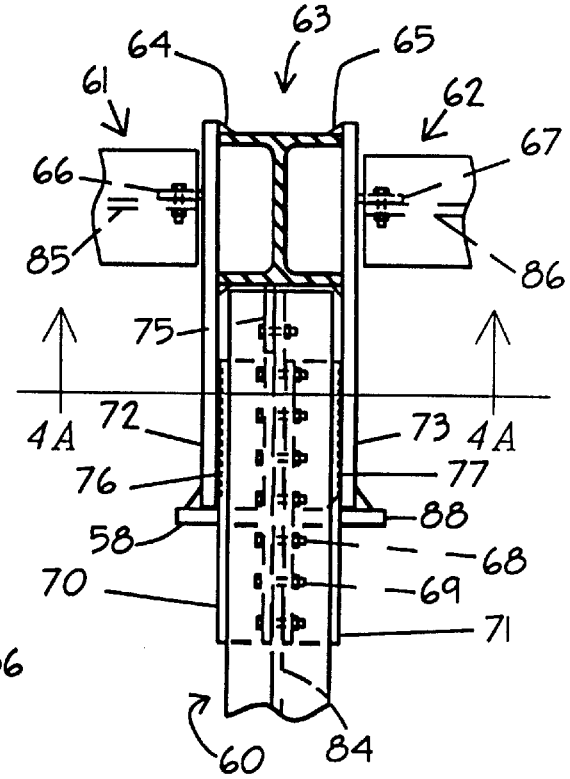
FIG. 4 is a top view of the structural joint of the invention, illustrating, in dotted lines, angle irons bolted to the web of the beam, shear tab plates bolted to the webs of the beams and gusset plates welded to the angle irons and column.

FIG. 4 is a top view of the structural joint of the invention, partially-hidden angle irons 70 and 71 bolted to the web of the beam 60 by bolts 68, 69 and other, similarly-placed bolts. Shear tab plates 66 and 67 are welded to gusset plates 72 and 73 and are either bolted or welded to the webs 85 and 86, respectively. The gusset plates 72 and 73 are fillet welded to angle irons 70 and 71 by fillet welds such as welds 76 and 77, in the same way as is shown by fillet welds 56 and 57, in FIG. 3. Shear tab plate 75 is bolted to the web of beam 60 and welded to the flange of column 63.

FIG. 4 also shows vertical shear plates 58 and 88 which are shown welded to gusset plates 72 and 73.

Figure 4A:
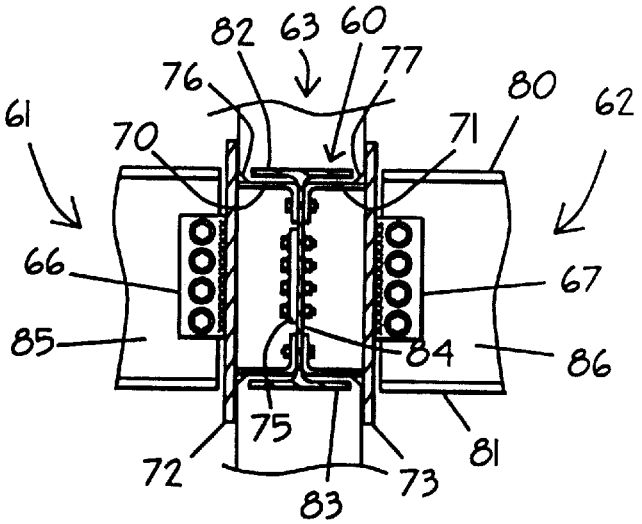
FIG. 4A is taken on line 4A—4A in FIG. 4, showing disposition of the angle irons bolted to the web of the beam and welded to the gusset plates.

FIG. 4A is taken on line 4A—4A in FIG. 4, and more clearly shows disposition of angle irons 70 and 71 which are bolted to web 84 of beam 60 and welded at welds 76 and 77 to gusset plates 72 and 73, a preselected distance below flange 82 of beam 60.

The angle irons, in the preferred embodiment, are placed a preselected distance below the flange of the beam so that the bolts extend through the web of the beam clear of the toe of the fillet between flange and web, of a rolled shape, or an equivalent distance on a beam wherein the flange is welded to the web. In the Manual of Steel Construction, Allowable Stress Design, Ninth Edition, published by the American Institute of Steel Construction, Inc., 1 East Wacker Drive, Suite 3100, Chicago, Ill., 60601, the distance from the outer face of the flange to the web toe of the fillet of a rolled shape or equivalent distance on a welded section in inches, is defined as the "k" dimension, which is located approximately 1 to 1.5 inches beyond the point of tangency between the fillet between flange and web, and web of the beam. Commonly, the distance between the top of the flange and the top of the angle iron would be approximately 15 percent of the distance between flanges. In various embodiments of the invention, the angle irons may be spaced a substantially greater distance from the flange than the "k" dimension. In still other embodiments, the angle irons may closely fit the fillet and be located close to the flange of the beam. A design engineer can, by analysis, determine possible locations.

Shear tab plates 66 and 67 are welded to gusset plates 72 and 73 and either bolted or welded to the webs 85 and 86 of beams 61 and 62. Beam 62 has a web 86, an upper flange 80 and a lower flange 81, connected by web 86. Beam 61 is similarly constructed. Beam 60 has upper flange 82 and lower flange 83 connected by web 84. The angle irons, such as 70 and 71 are bolted to the web 84 and welded to the gusset plates 72 and 73 by fillet welds 76 and 77. Additional angle irons are similarly placed, bolted and welded near the lower flange 83 of beam 60. Similar fillet welds (not shown) are used between gusset plates 72 and 73 and column 63.

Welds other than fillet welds are well-known and in common use, such as partial and complete penetration groove welds and still other welds. In particular circumstances, such other welds may be found suitable, but the fillet weld is the preferred weld used throughout this invention. It is most economical. It is particularly significant that the greatest stress on the fillet welds between gusset plates and angle irons, is in the direction of the weld, which loads the weld in shear. On the other hand, in the prior art, the greatest stress on the groove welds, between beam flange and column flange, is perpendicular to the direction of the weld, which loads the weld in tension, leading to much greater susceptibility to brittle fracture in the weld.

Figure 5:
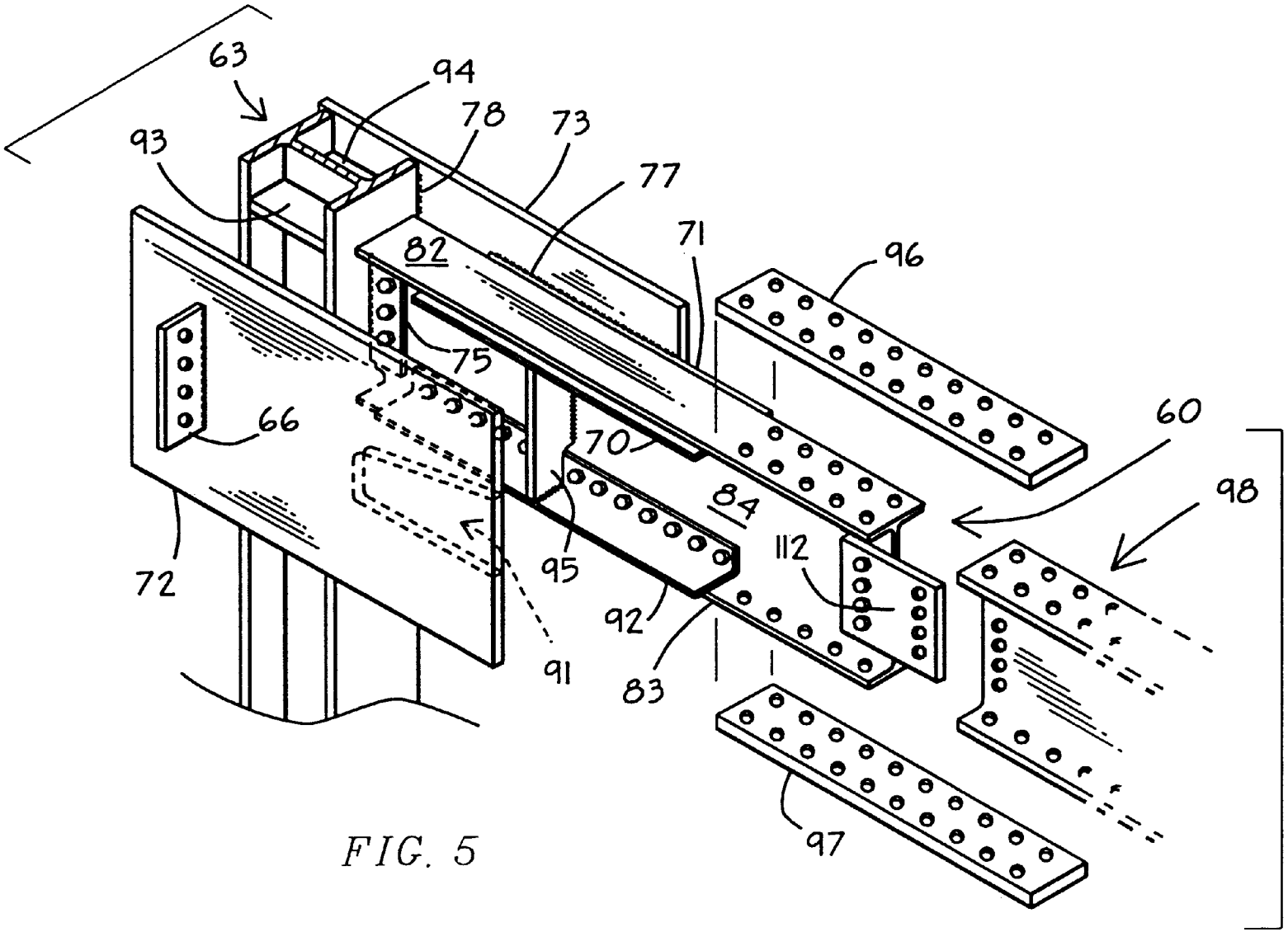
FIG. 5 is an isometric, partially-exploded view of a preferred form of the invention, closely similar to that shown in FIGS. 4 and 4A, showing angle irons bolted to the web of the beam and welded to the gusset plates, illustrating, in phantom, an alternative cutout in the gusset plates to permit easier access, such as, bolt insertion and tightening, welding the angle irons to the gusset plates and welding the column flanges to the gusset plates.

FIG. 5 is an isometric, partially-exploded view of a preferred form of the invention, substantially similar to that shown in FIGS. 4 and 4A, showing angle irons 70, 71 and 92 bolted to the web of the beam. Such angle irons are connection means connecting the gusset plates to the beam. Welding of the angle irons to the gusset plates 72 and 73 is shown, for example, by fillet weld 77. Again, it is noted that fillet weld 77 extends in the direction of the beam 60, in the direction of the greatest stress. Angle irons 70, 71, 92 and its counterpart angle iron (not shown) on the opposite side of the web 84, are all welded similarly to gusset plates 72 and 73. Fillet weld 78 illustrates how the gusset plates are welded to the column 63. Preferably, the gusset plates 72 and 73 are welded to the column 63 along the flanges of the column as shown by fillet weld 78.

Gusset plates 72 and 73 are shown as being rectangular in FIG. 5 and other Figs. herein. However, it is to be appreciated that other shapes of gusset plates may be used, such as, trapezoidal, polygon and still other shapes depending on the particular circumstances.

Horizontal shear plates 93 and 94 are welded within the column 63 as is customary in the art. A similar set of horizontal shear plates is located within the column 63 near the lower flange 83 of the beam 60. The horizontal shear plates are welded on all four edges, to gusset plates, column web and flanges, using fillet welds. Such plates are not necessary when the column is a box section or tubular section.

Horizontal shear plates may, of course, vary somewhat from being truly "horizontal", depending on the particular circumstances.

FIG. 5 also shows a vertical shear plate 95 which is welded, by fillet welds, to web 84, angle irons 70 and 92 and to gusset plate 72. A corresponding vertical shear plate would be similarly attached on the other side of beam 60. Although vertical shear plate 95 is shown connected intermediate the ends of gusset plate 72, it is to be appreciated that it could also be readily fillet welded if disposed at the end of gusset plate 72.

Shear tab plate 75 is welded to the flange of column 63 and bolted to the web 84 of beam 60. Shear tab plate 66 is welded to gusset plate 72 and is to be bolted or welded to the beam which extends orthogonally to beam 60. A similar shear tab plate is located on gusset plate 73.

Gusset plate 72 illustrates, in dotted lines, an alternative cut-out 91, which may be constructed in both gusset plates 72 and 73 to permit easier access, for such purposes as bolt insertion and tightening, welding the angle irons to the gusset plates and welding the column flanges to the gusset plates. FIG. 5 also shows how beam 60 may be spliced to a continuation beam 98, using splice plates 96 and 97. A shear tab plate, such as that shown in FIG. 16, shear tab plate 204, may be welded or bolted to web 84 and the web of beam 98.

Again, as seen in FIG. 3, it can be seen in FIG. 5 that the angle irons 70, 71 and 92 are bolted to the web 84 of beam 60 along its longitudinal direction for substantially the length the gusset plates 72 and 73 extend along the sides of beam 60. This design provides an energy dissipating mechanism, by reason of bolt slippage.

Figure 6:
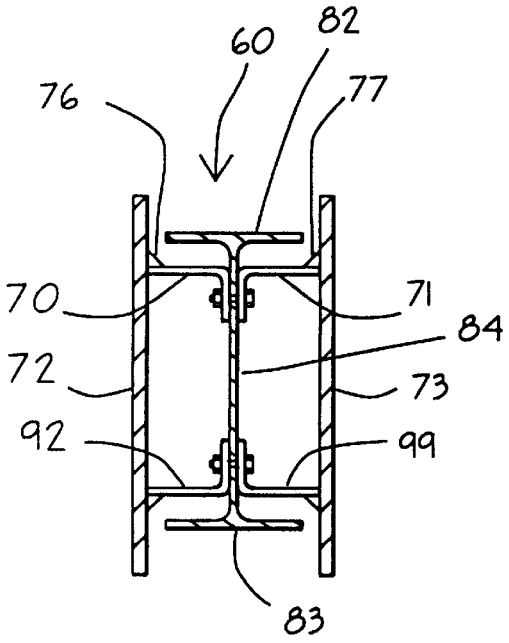
FIG. 6 is a cross-section of a beam, whose web is bolted to angle irons which are welded to gusset plates, in which the angle irons are spaced a substantial distance from the flanges of the beam.

FIG. 6 is a cross-section of a beam 60 whose web 84 is bolted to angle irons 70, 71, 92 and 99 which are welded to gusset plates 72 and 73, in accordance with previously discussed embodiments. In this embodiment, the angle irons are spaced a greater distance from the flanges 82 and 83 of the beam, than shown in previous Figs. It is noted that there is still access to be able to place fillet welds, such as 76 and 77 between the angle irons 70 and 71 and the gusset plates 72 and 73. If for some reason there is not sufficient access, cut-out plates such as shown in FIG. 5, may be used, which would allow welding on the underside of the angle irons 70 and 71 to gusset plates 72 and 73.

Figure 7:
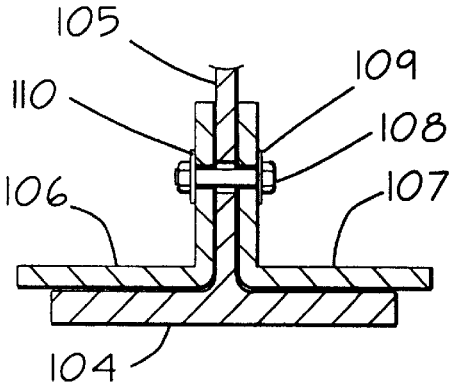
FIG. 7 is a cross-section of a web and flange of a beam, illustrating angle irons bolted to both sides of the web, showing the oversize hole in the web and washers, bolt and nut.

FIG. 7 is a cross-section of a flange 104 and a web 105 of a beam, illustrating angle irons 106 and 107 bolted to both sides of the web 105. Bolt 108 extends through both angle irons 106 and 107 and, also through the web. The bolt holes may be drilled to be oversize through the angle irons 106 and 107 and slightly greater oversized through the web 105. The bolts used in the invention are, of course, high-strength bolts.

The oversize bolt holes allow easier fitting together and, further, provide an energy dissipation mechanism through bolt slippage at high stress levels. Washers 109 and 110 are included, in accordance with customary practice. Although washers are not shown in other Figs. because they are so small, it is expected that all bolting would include washers. The bolts used throughout the invention are high strength bolts which can be field or shop bolted. The bolts used in the invention are in double shear except for those on the shear tab plates, such as 66, 67 and 75, FIG. 4A, bolted to webs 85, 86 and 84. Also in double shear are those bolts, or rivets, as the case may be, connecting the angle irons to the beam flange, such as shown in FIG. 13 and those bolts, or rivets, connecting angle irons to gusset plates, such as shown in FIG. 17. If desired, those bolts, too, can be placed in double shear by addition of additional shear tab plates on the opposite sides of the webs 84, 85 and 86. The bolt holes may be oversized and the bolts and nuts are tightened to be slip-critical, meaning the adjoining metal plates cannot slip or move under designed load. FIG. 7 shows bolting the angle iron well away from the toe of the fillet between flange and web, nevertheless, the angle iron is nested closely against the flange 104, in this embodiment.

Figure 8A:
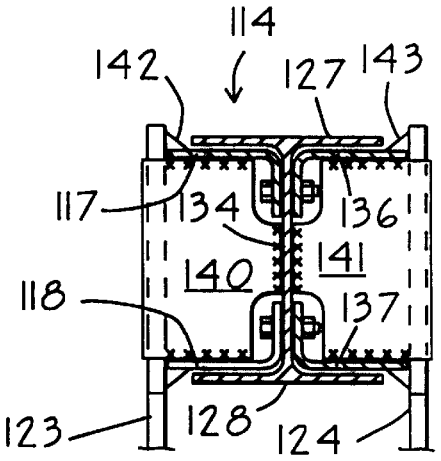
FIG. 8A is a cross-section taken on line 8A—8A of FIG. 8, showing the beam flanges and web, the angle irons, bolts, gusset plates and vertical shear plates welded to the web, the angle irons and the gusset plates.
Figure 8B:
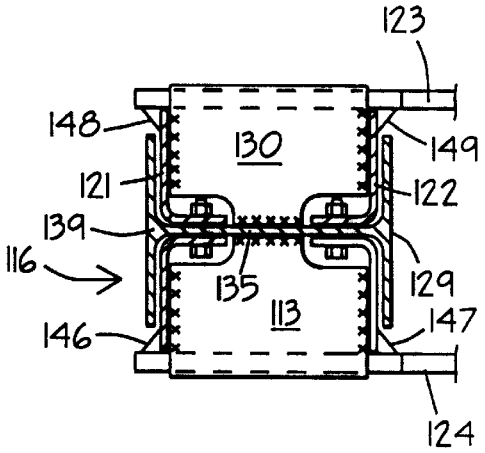
FIG. 8B is a cross-section taken on line 8B—8B of FIG. 8, showing the column flanges and web, the angle irons, bolts, gusset plates and horizontal shear plates welded to the web, the angle irons and the gusset plates.
Figure 8:
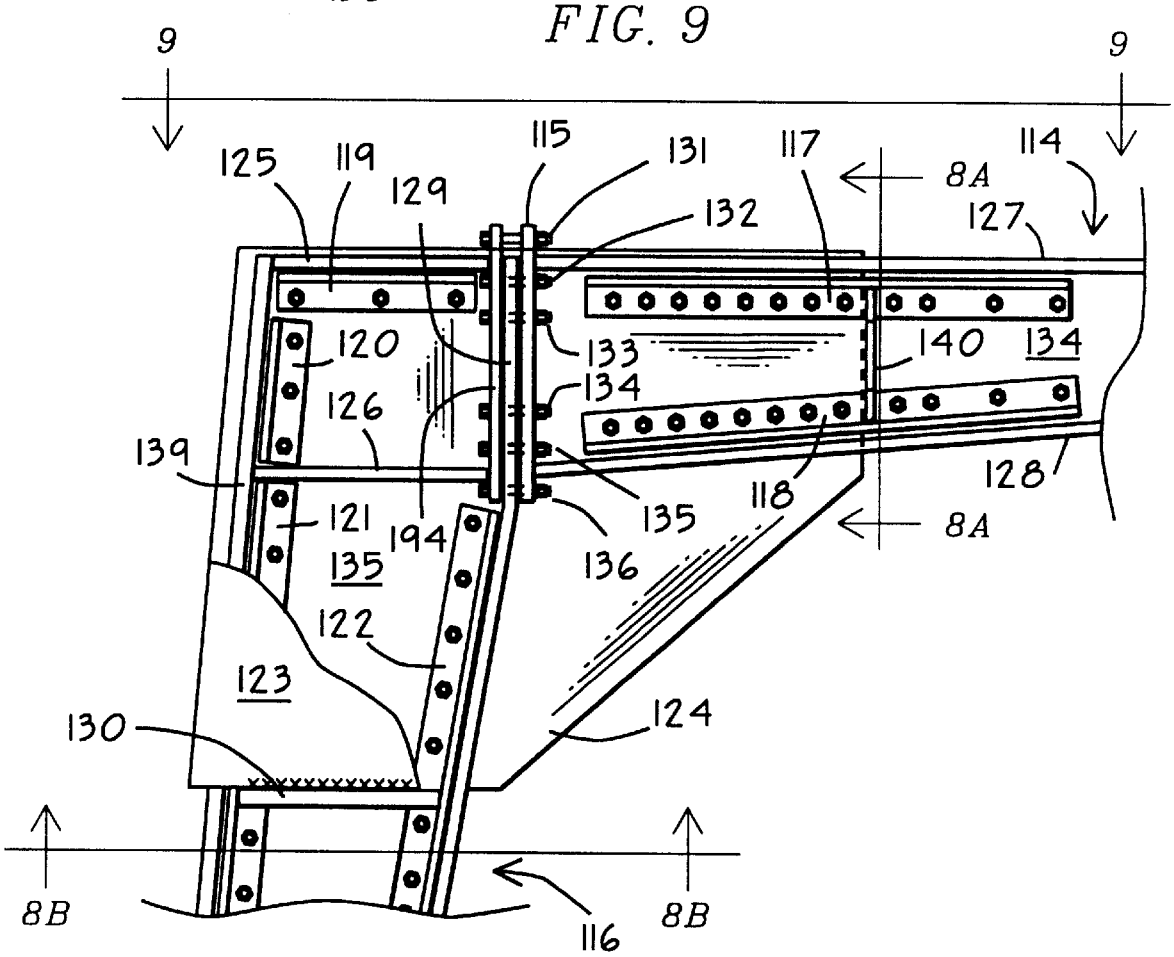
FIG. 8 illustrates a retrofit construction having a previously-constructed structural joint in which a beam has an endplate which is bolted to a column flange. Angle irons are bolted to both beam and column to strengthen the connection. The angle irons are welded to the gusset plates. The near gusset plate is shown only partially, in break-away.

FIG. 8 illustrates a retrofit construction having a prior-constructed structural joint in which a beam 114 has an endplate 115 which is bolted to a flange 129 of column 116. Angle irons 117 and 118 are bolted to the web 134 of beam 114. Angle irons 119 and 120, are bolted to the web 135 of column 116. Of course, counterpart angle irons are similarly disposed on the opposite sides of those webs are bolted with the same bolts shown. Such angle irons 117 and 118, and their counterparts on the other side of web 134 of beam 114, substantially strengthen beam 114. Similarly, angle irons 121 and 122, and their counterparts on the other side of web 135, are bolted to the web 135 and substantially strengthen column 116.

The angle irons 117–122 are welded to the gusset plates 123 and 124. The near gusset plate 123 is shown only partially, in break-away. Continuation plates 125 and 126 are illustrated, aligned with flanges 127 and 128 and beam 114 as is customary in the art. Horizontal shear plate 130 is shown fillet welded to the bottom end of gusset plate 123 and, at least, the web 135 of column 116. A corresponding horizontal shear plate, (not shown), would be similarly welded on the far side of column 116 to the other side of web 135 and to the bottom end of gusset plate 124. In another embodiment, horizontal shear plates, such as 130 may be disposed at a higher level, between the gusset plates 123 and 124 and the opposing sides of the web 135. Such horizontal shear plates are similar to vertical shear plates 140 and 141.

Figure 9:
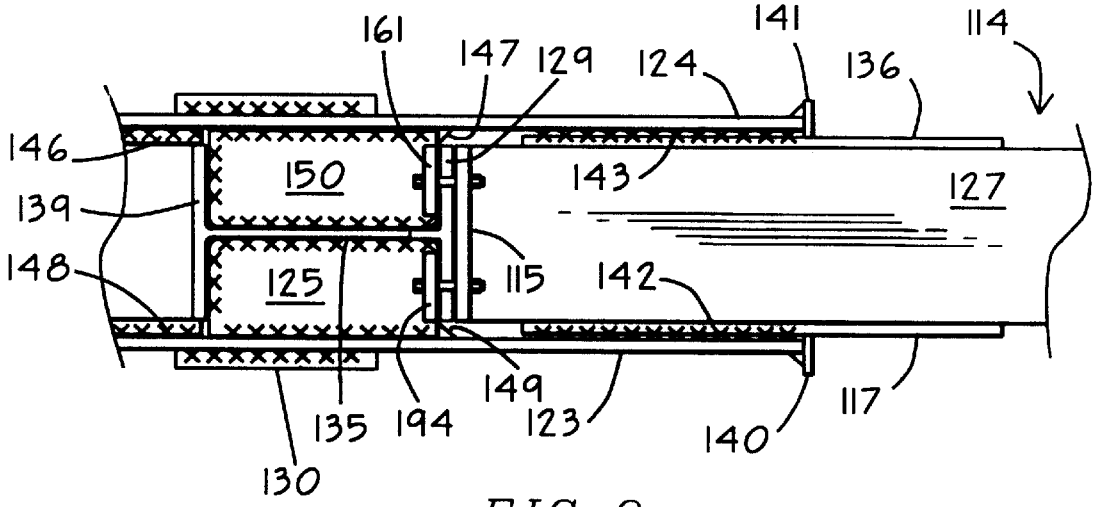
FIG. 9 is a top view of FIG. 8 taken on the line 9—9, with both gusset plates in place.

Similarly, as can be seen from FIG. 9, continuation plate 125 is welded to gusset plate 123 and one side of web 135 of column 116. Such continuation plates 125 and 150 may also be welded to flanges 139 and 129 of column 116. Continuation plate 126 and its corresponding plate may also be welded to flanges 139 and 129 of column 116.

In some constructions, particularly retrofit constructions, continuation plates 125 and 150 may not be wide enough to touch the gusset plates 123 and 124 and are not, therefore, welded to such gusset plates. In new construction or additive construction wherein continuation plates 125 and 150 are added, they may be made sufficiently wide so that they can be welded to gusset plates 123 and 124.

This above applies similarly to continuation plate 126 and its corresponding continuation plate on the other side of web 135.

In FIG. 8, in strengthening such prior structural joint by applying the invention herein, the bolts 131 to 136 may be loosened and their threads spoiled to permit such bolts to only resist shear. This allows the gusset plates 123 and 124 to resist all flexure and axial loads. It is noted that the angle irons 117 and 118 extend a substantial distance beyond the end of the gusset plates 123 and 124 along beam 134. This serves to further strengthen the beam 114. Similarly, angle irons 121 and 122 extend a substantial distance beyond the end of the gusset plates 123 and 124 along column 116. This strengthens the column 116. A skilled structural engineer would easily be able to determine how far such angle irons should extend, in order to provide the intended strength.

As discussed previously, welding the angle irons to the gusset plates provide an excellent, moment resisting, beam-to-column connection. Angle irons may extend the full length of a beam or column to strengthen it. Bolt spacing may become larger as the angle iron extends away from the beam to column connection.

FIG. 8A is a cross-section taken on line 8A—8A of FIG. 8, showing the beam flanges 127 and 128 and web 134. The angle irons 117 and 118 and their counterpart angle irons 136 and 137 are bolted to web 134 of beam 114. Vertical shear plate 140 and its counterpart vertical shear plate 141 are shown. Such vertical shear plates are welded to the web 134 of the beam 114, the angle irons 117, 118, 136 and 137 and the gusset plates 123 and 124. Fillet welds such as welds 142 and 143 weld such angle irons to the gusset plates 123 and 124. Horizontal shear plate 130 is fillet welded to gusset plate 123 and, at least, the web 135 of column 116. A corresponding horizontal shear plate would be similarly welded on the other side of column 116.

It is to be appreciated that, in another structure similar to FIG. 8, the horizontal beam 114 could be a vertical column and vertical column 116 could be a horizontal beam, by rotation of the FIG. 8 structure by 90 degrees. In such configuration, endplate 115 would become a horizontal bearing plate at the top of the column, (beam 114), and beneath the beam, (column 116). Again, bolts 131 to 136 may be loosened and their threads spoiled to permit such bolts only to resist shear.

FIG. 8B is a cross-section taken on line 8B—8B of FIG. 8, showing the column 116 in cross-section, and its flanges 129 and 139 and its web 135. Four angle irons are shown, such as angle irons 121 and 122. Such angle irons are shown bolted to the web 135 of column 116. Horizontal shear plates 113 and 130 are welded to the web 135 of column 116 and, also, to the angle irons and to the gusset plates 123 and 124. The weld between horizontal shear plates 113 and 130 to their respective gusset plate is better seen in FIG. 8 which clearly shows horizontal shear plate 130 fillet welded to gusset plate 123.

FIG. 9 is a top view of FIG. 8 taken on the line 9—9, with both gusset plates 123 and 124 in place. Fillet welds 146–149 are between gusset plates 123 and 124 and the angle irons, such as angle irons 120, 121, and 122, (seen in FIG. 8), bolted to the web of column 116. Continuation plate 125 and its counterpart 150 are welded to web 135 of the column 116 and beam flanges 129 and 139, as well as to gusset plates 123 and 124. In some instances, of retrofitting, continuation plates 125 and 150 may not be welded to gusset plates 123 and 124.

The ends of vertical shear plates 140 and 141 may be seen. Such shear plates are fillet welded to gusset plates 123 and 124. It may also be seen how the horizontal legs of angle irons 117 and 136 are welded by fillet welds 142 and 143 to gusset plates 123 and 124.

Endplate 115, which is attached to the end of beam 114, is bolted to the flange 129 of column 116 and through vertical plates 161 and 194. Such vertical plates may not be necessary if flange 129 is of sufficient strength, in which case, endplate 115 would be simply bolted, riveted or welded to the flange 129 of column 116. Alternatively, if the flange 129 of column 116 terminates, as it sometimes does, at or near the bottom of beam 114, a second endplate, fastened to web 135 of column 116, would be bolted, riveted or welded to endplate 115.

FIG. 10 is a cross-section of a beam 152 in a joint connection with gusset plates 153 and 154, showing the angle irons 155–158 located close to the flanges 159 and 160 of the beam 152.

FIG. 11 is a cross-section of a beam to gusset plate connection which is taken on line 11—11, FIG. 12, which may be referred to momentarily. FIG. 11 shows the angle irons 162–165 spaced a substantial distance from the flanges 166 and 167 of the beam, and reversed in their disposition from that shown in FIG. 10. Hidden lines show the column web 168 and horizontal shear plates 169 and 170 within the column 171. The shear tab plate 172 is shown bolted to web 173 of the beam. It is noted that fillet welds 177, 178 and 187 are inside and may be accessible through cut-outs, (see FIG. 12) in gusset plates 179 and 180. Shear tab plates 174 and 175 are shown, illustrating how additional beams may be connected to the gusset plates as previously shown in FIGS. 3, 4 and 4A.

FIG. 12 is a side view of FIG. 11, showing one of the gusset plates 179 having a cut-out 183. Of course, counterpart gusset plate 180 has a similar cut-out which cutouts allow access to bolt and weld within the joint area. In hidden lines, the horizontal shear plates 169 and 170 are shown. Also shown, in hidden lines, are the fillet welds 184 and 185 between gusset plate 179 and horizontal shear plates 169 and 170 and fillet welds 186 and 187 between gusset plate 179 and column flanges 181 and 182. Similar welds are made to counterpart gusset plate 180, which is not visible in this Fig. Shear tab plate 172 is, of course, welded to column flange 182, but is hidden in the Fig. by fillet weld 187.

Flange 166 of the beam 151 has been cut away from its pre-existent weld to flange 182, as has flange 167. Also flanges 166 and 167 have been back-gouged at gouges 188 and 189, to cut the flanges of beam 151 free of column 172, except for shear tab plate 172 and gusset plate 179 and its invisible opposing gusset plate 180, which is visible in FIG. 11.

FIG. 12 also shows vertical shear plate 176 which is welded by fillet weld to gusset plate 179 and web 173 of beam 151. A corresponding vertical shear plate, (not shown), would be fillet welded to the opposing gusset plate 180, (seen in FIG. 11), and the other side of the web 173 of beam 151.

FIG. 13 is a cross-section of a beam to gusset plate connection, showing angle irons 190 and 191 bolted to the flange 159 of a beam and welded by fillet welds to the gusset plates 192 and 193.

FIG. 14 is a side view of a beam-to-column connection, similar to that of FIG. 12, having the near gusset plate 179 broken away, illustrating a cut-out 183 in the gusset plate, and partly showing horizontal shear plates 169 and 170 within the column 171. Counterpart gusset plate 180 is partially visible. In dotted lines is shown an alternative means of welding the angle irons 162 and 164 to the gusset plate 179, from the outer sides of the plates, using plug welding through the holes such as at 195, 196 and 197.

FIG. 15 is a cross-section of a beam to gusset plate connection which illustrates a reversal of angle irons 162–165, from that shown in FIG. 13. In both FIGS. 15 and 13, the angle irons are bolted to the flanges of the beam and welded to the gusset plates. However, FIG. 15 configuration is the configuration contemplated in FIG. 14, in which the plug welds might be used, if access through cut-out 183 is difficult or, alternatively, if there are no cut-outs in the gusset plates 179 and 180.

Figure 16:
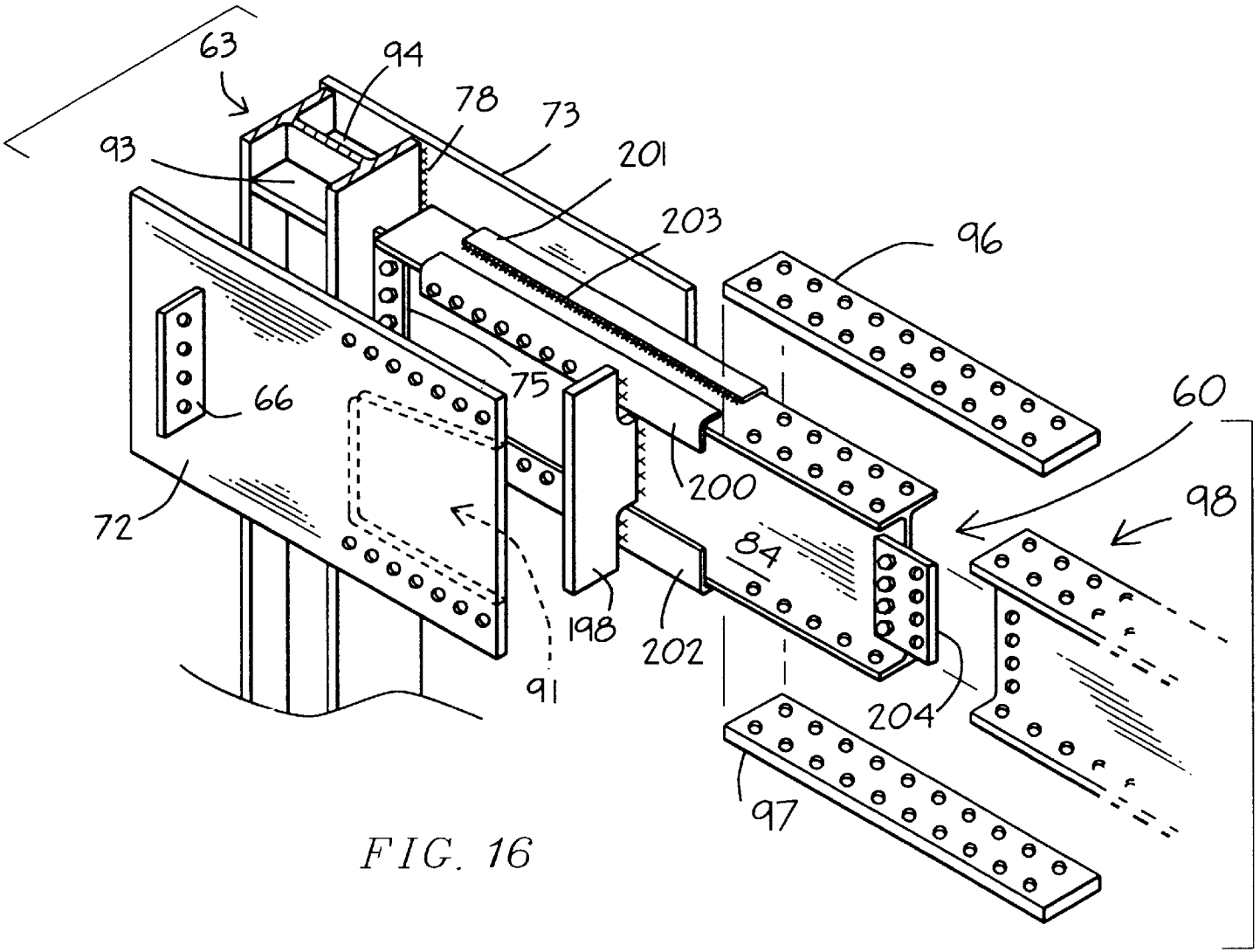
FIG. 16 is an isometric, partially exploded view, of a beam-to-column connection in which the front plate is moved away from the structural joint connection and in which angle irons are bolted to the gusset plates and welded to the flanges of the beam. Hidden lines illustrate the possibility of having cut-out gusset plates for easier access.

FIG. 16 is an isometric, partially exploded view, of a beam-to-column connection in which the front plate 72 is moved away from the structural joint connection, for illustration purposes, and in which angle irons 201, 200 and 202 are shown to be bolted to the gusset plates 72 and 73. The angle irons are welded to the flanges of the beam 60, as shown in the example of fillet weld 203. Hidden lines 91 illustrate the possibility of having cut-outs in the gusset plates for easier access to do the necessary bolting or riveting, as the case may be.

Splice plates 96 and 97 illustrate possible connection to a continuation beam 98 by bolting the splice plates to flange 82 and the upper flange of continuation beam 98. Shear tab plate 204 may also be used in making a strong connection to the continuation beam. It is noted that shear tab plate 204 is shown as bolted to web 84 and is intended to be bolted to the web of continuation beam 98. However, it is to be appreciated that the shear tab plate 204 could be welded or riveted, rather than bolted, to either or both.

FIGS. 17–24 illustrate various alternative embodiments in which bolts or rivets may be used to attach a beam to gusset plates, which gusset plates, are, of course, fixed to a column or to be fixed to a column. The connection means, connecting the gusset plates to the beams, in these Figs., include both angle irons and cover plates. Of course, connection means, angle irons and plates, may also be used to connect the gusset plates to the columns.

FIG. 17 is a cross-section of a beam 60 to gusset plate connection means in which angle irons 70 and 71, and 74 and 79, are bolted to the gusset plates 72 and 73 and, also, bolted to the flanges of beam 60.

FIG. 18 is a cross-section of a beam 60 to gusset plate connection means similar to that of FIG. 17, but reversed in position, in which the angle irons 70 and 71, and 74 and 79, are bolted to the gusset plates 72 and 73 and to the flanges of beam 60.

Shear plates 198 and 199 are shown in FIG. 18 as welded to the web 84. Shear plates 198 and 199 are, of course, welded, on their hidden side, to gusset plates 72 and 73. Each of the embodiments of FIGS. 17–24 would be expected to have such shear plates, or similar shear plates, between web and gusset plates, in connection with their construction. Various locations of both horizontal shear plates, (between column and gusset plates), and vertical shear plates, (between beam and gusset plates), have been shown and discussed hereinabove.

FIG. 19 is a cross-section of a beam 60 to gusset plate connection means in which the angle irons 70 and 71, and 74 and 79, are bolted to the gusset plates 72 and 73 and welded to the outer faces of the flanges of the beam of beam 60.

FIG. 20 is a cross-section of a beam 60 to gusset plate connection means in which connection plates 89 and 90 are bolted to the upper and lower flanges of the beam 60. and welded to the gusset plates 72 and 73. The connection plates are on the outer faces of the flanges of the beam 60.

FIG. 21 is a cross-section of a beam 60 to gusset plate connection means in which two connection plates 100 and 101 are bolted to the upper flange of the beam 60 and welded to the gusset plates 72 and 73, and two connection plates 102 and 103 are bolted to the lower flange of the beam 60 and welded to the gusset plates 72 and 73.

FIG. 22 is a cross-section of a beam 60 to gusset plate connection means, similar to that shown in FIG. 21, in which two connection plates 100 and 101 are riveted to the upper flange of the beam 60 on the underside of the flange and two connection plates 102 and 103 are riveted to the lower flange of the beam 60 on the underside of the flange, and all the connection plates are welded to the gusset plates.

FIG. 23 is a cross-section of a hybrid, beam 60 to gusset plate connection means in which a connection plate 89 is welded to the upper flange of the beam 60 and the gusset plates 72 and 73. Angle irons 74 and 79 are connected to the web of the beam near the lower flange of the beam 60 and welded to the gusset plates 72 and 73.

FIG. 24 is a cross-section of a beam 60 to gusset plate connection means in which two connection plates 100 and 101 are welded to the upper flange of beam 60 and welded to the two gusset plates 72 and 73. The two angle irons 74 and 79 are bolted to the web of the beam 60, at the lower flange, and welded to the gusset plates 72 and 73.

Figure 25:
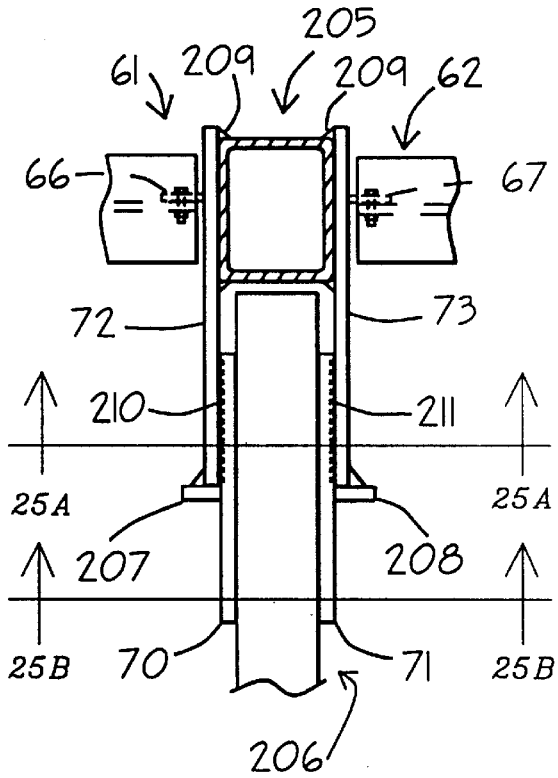
FIG. 25 is an illustration of a box column and a box beam, illustrating connection of the gusset plates thereto. Hidden lines show the angle irons bolted to the box beam. The gusset plates are welded to the angle irons.

FIG. 25 is an illustration of a box column 205 and a box beam 206, illustrating connection of the gusset plates 70 and 71 thereto. Angle irons 70 and 71 are welded to gusset plates 72 and 73, by welds 210 and 211. The angle irons 70 and 71 are similarly welded to box beam 206.

Figure 25A:
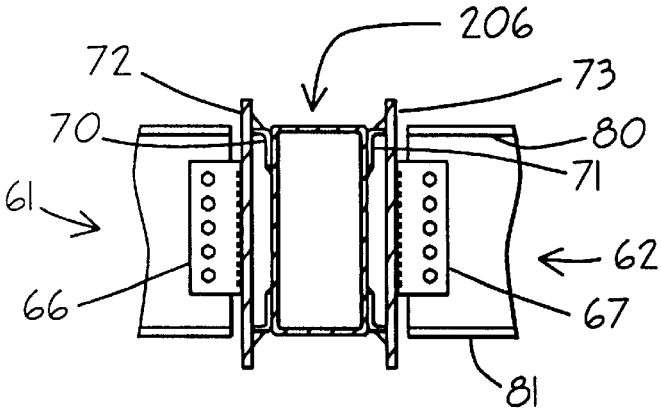
FIG. 25A is taken on line 25A—25A of FIG. 25, illustrating the box beam and the angle irons bolted thereto.

FIG. 25A is taken on line 25A—25A of FIG. 25, illustrating the box beam 206 more clearly and the angle irons 70 and 71, and their counterpart angle irons, all welded to such box beam 206. Also shown are vertical shear plates 207 and 208 which are fillet welded to gusset plates 72 and 73, respectively, and to opposing sides, the web of box beam 206.

Figure 25B:
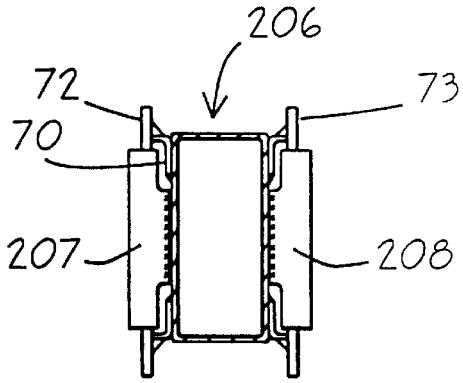
FIG. 25B is taken on line 25B—25B of FIG. 25, illustrating the box beam and the endplate connections to box beam and gusset plates, relative to the angle irons, which also connect the box beam to the gusset plates.

FIG. 25B is taken on line 25B—25B of FIG. 25, illustrating the box beam 206 and the endplates 207 and 208 which are connected between the box beam 206 and gusset plates 72 and 73. This view shows the relationship between the endplates and the angle irons, such as angle iron 70, in which both angle irons and endplates are connected between the box beam and the gusset plates 72 and 73.

Figure 26:
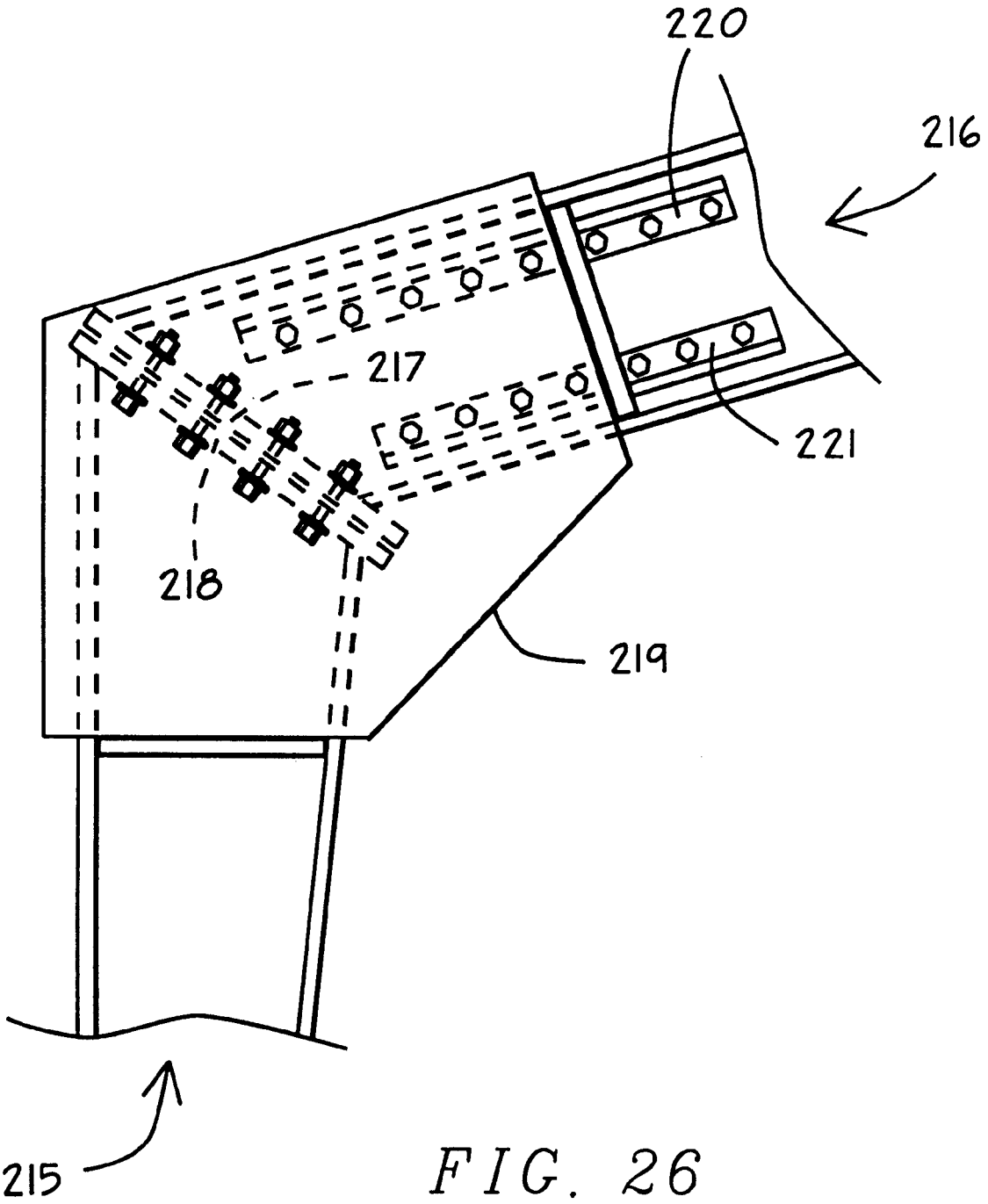
FIG. 26 illustrates a gusset plate construction in which a column and a beam are connected in an obtuse angle and in which the beam and the column each have an endplate, which endplates are bolted to each other.

FIG. 26 illustrates a gusset plate construction in which a column 215 and a beam 216 are connected in an obtuse angle and in which the beam has an endplate 217 and the column has an endplate 218. Such endplates are shown in dotted lines because they are covered by gusset plates of which only the near gusset plate, gusset plate 219 is visible. Endplate 217 is welded to the end of beam 216. Endplate 218 is welded to the end of column 215. It is noted that the endplates 217 and 218 are disposed diagonally across the ends of the column 215 and beam 216 and such endplates are bolted together. Angle irons 220 and 221 extend along beam 216 and are fastened thereto by being bolted. Bolting is the preferred construction, although the angle irons may be riveted or welded as previously discussed. Such angle irons are welded to gusset plate 219. Of course, a corresponding gusset plate exists on the opposite side of column 215 and beam 216 and corresponding angle irons exist on the opposite side of beam 216. Angle irons may similarly be connected between the gusset plate 219, (and its corresponding gusset plate, not shown), and column 215, as previously shown in FIG. 8.

Although specific embodiments and certain structural arrangements have been illustrated and described herein, it will be clear to those skilled in the art that various other modifications and embodiments may be made incorporating the spirit and scope of the underlying inventive concepts and that the same are not limited to the particular forms herein shown and described except insofar as determined by the scope of the appended claims.

I claim:

1. A beam-to-column structural joint connection comprising a beam and a column, said structural joint connection further comprised of two gusset plates disposed in parallel relationship on opposite sides of said column and fixedly attached with respect to said column and said beam, said gusset plates facing each other across said column, wherein said beam has two ends, one end disposed at or near said column and the other end disposed away from said column, wherein each of said gusset plates has a length which, at least, extends across said column and away from said column along the sides of said beam, wherein said gusset plates have a width extending along said column for at least the width of said beam, wherein is included a plurality of angle irons, wherein each said angle iron extends longitudinally in length, wherein said gusset plates are fixedly attached with respect to said column and said beam, wherein said gusset plates are fixedly attached with respect to one or both of said column and said beam by each of said angle irons being fixedly attached to a respective one of said gusset plates and a respective one of (a) said beam or (b) said column, wherein the longitudinal length of each said angle iron lies substantially along the longitudinal length of its respective said beam or said column, wherein each of said longitudinally-extending angle irons is fixedly attached to a respective one of (a) said beam or (b) said column, for substantially the same or a greater length that said gusset plates extend along said one of said beam or said column.

2. The structural joint connection of claim 1, wherein is included two vertical shear plates, wherein said gusset plates are further fixedly attached with respect to said beam by said vertical shear plates being welded to said beam, on opposite sides of said beam, and wherein each of said shear plates is welded to a respective one of said gusset plates.

3. The structural joint connection of claim 2 wherein said vertical shear plates are welded to said gusset plates at or near the end of said gusset plates.

4. The structural joint connection of claim 1 wherein said beam has one or more webs, and wherein is included fasteners, and wherein said angle irons are fixedly attached to said beam by being fastened to said one or more webs of said beam by said fasteners, wherein said angle irons are fastened longitudinally along said one or more webs for substantially the length said gusset plates extend along the sides of said beam, or farther.

5. The structural connection of claim 4, wherein said fasteners are comprised of bolts and nuts.

6. The structural joint connection of claim 5 wherein said beam has upper and lower flanges, and wherein at least a plurality of said angle irons are fixedly attached to said beam by being fixedly attached to said flanges of said beam by said bolts and nuts.

7. The structural joint connection of claim 1 wherein said beam is comprised of an upper and a lower flange and a web connected between said flanges, wherein is included fasteners, and wherein said angle irons are fixedly attached to said beam, and wherein said angle irons are fastened to said web a preselected distance from said flanges by said fasteners, which fasteners extend through said web.

8. The structural joint connection of claim 1 wherein each of said angle irons is fixedly attached to a respective one of said gusset plates by being one or more of fastened or welded to said respective one of said gusset plates.

9. The structural joint connection of claim 1 wherein said beam has a web, and wherein is included fasteners, wherein each of said angle irons is fixedly attached to said beam by each of said angle irons being fastened by said fasteners to said web, wherein each of said angle irons is fixedly attached to a respective one of said gusset plates by each of said angle irons being welded to a respective one of said gusset plates, wherein is further included two vertical shear plates, and wherein said beam is further fixedly attached with respect to said gusset plates by each of said vertical shear plates being welded to said web of said beam, on opposite sides thereof, and wherein each said vertical shear plate is welded to a respective one of said gusset plates.

10. The structural joint connection of claim 1 wherein said beam has an upper and lower flange and wherein said angle irons are fixedly attached to said beam by said angle irons being welded to said flanges, and wherein is included fasteners, and wherein said angle irons are fixedly attached to said side plates by being fastened by said fasteners to said side plates.

11. The structural joint connection of claim 1 wherein said angle irons are fixedly attached to said beam by a first plurality of said angle irons being bolted to said beam, and a second plurality of said angle irons being bolted to said column.

12. The structural joint connection of claim 11 wherein said beam and said column each have a web and said plurality of angles irons are bolted to said beam and said column by being bolted to said webs of said beam and said column.

13. The structural joint connection of claim 1 wherein said beam has a single web, wherein is included a plurality of bolts and nuts, wherein said angle irons are fixedly attached to said beam by said plurality of angle irons being disposed in pairs, wherein each angle iron of a pair is disposed on opposing sides of said web of said beam and said angle irons of each pair being congruent with each other, wherein said angle irons are fixedly attached with respect to said beam by said plurality of bolts and nuts, wherein said bolts extend through each said angle iron of a pair and said web therebetween, wherein each said angle iron is welded to a respective one of said gusset plates, wherein is further included two vertical shear plates, and wherein said beam is also fixedly attached with respect to said russet plates by each said vertical shear plate being welded to said web and to a respective one of said gusset plates.

14. A beam-to-column structural joint connection comprising a beam and a column, said structural joint connection further comprised of two gusset plates disposed in parallel relationship on opposite sides of said column and fixedly attached with respect to said column and said beam, said gusset plates being in face-to-face relationship with respect to each other, said gusset plates extending from said column along the sides of said beam, wherein the improvement comprises a plurality of angle irons, wherein said gusset plates are fixedly attached with respect to said column and said beam, by said angle irons being fixedly attached to said gusset plates and one or more of (a) said beam and (b) said column, and wherein said angle irons are fixedly attached to said gusset plates and one or more of (a) said beam and (b) said column by said angle irons being fixedly attached to one or more of said beam and said column for a distance extending along one or more of said beam and said column beyond the end of said gusset plates.

15. A structural joint comprising a column having at least two flanges and one or more webs connected between said flanges of said column, a beam having at least two flanges and one or more webs connected between said flanges of said beam, said beam having an end disposed at or near one of the flanges of said column, said beam extending away from said column, two gusset plates, said gusset plates being disposed on opposite sides of said column from each other, said gusset plates facing each other across said column, and congruent with each other, wherein the improvement comprises;

wherein each of said gusset plates extends in length, at least the width of said column and along the sides of said beam, wherein each of said gusset plates extends in width along said column for at least the width of said beam, connection means connecting each of said gusset plates to one or more of said beam and said column, wherein said connection means are welded to said gusset plates, wherein is included fasteners, and wherein said fasteners fasten said connection means to one or more of said beam and said column for at least substantially the distance said gusset plates extend along said beam or said column.

16. The structural joint of claim 15 wherein said connection means comprises a plurality of shear plates, wherein said connection means also comprises a plurality of angle irons, wherein each said angle iron is fastened to a respective one of said webs, wherein said shear plates are welded to the portion of said one or more webs between said fastened angle irons ,and wherein each said shear plate is welded to a respective one of said gusset plates.

17. The structural joint of claim 15 wherein said fasteners fasten said connection means by said fasteners extending through said connection means and through said one or more webs of said beam.

18. The structural joint of claim 15 wherein said connection means comprises angle irons, wherein said beam has only one web, wherein said column has only one web, wherein said fasteners fasten said connection means by fastening said angle irons to one or more of (a) said web of said beam and (b) said web of said column by each of said fasteners extending through said angle irons and through a respective one of said webs.

19. The structural joint of claim 18 wherein said angle irons are fastened by said fasteners extending through a respective one of said webs a preselected distance from said flanges.

20. The structural joint of claim 15 wherein said fasteners fasten each one of said connection means to a respective web of (a) said one or more webs of said column and (b) said one or more webs of said beam.

21. The structural joint of claim 15 wherein is included an endplate fixedly attached to said end of said beam which is at or near said column, wherein said endplate is attached to a flange of said column.

22. The structural joint of claim 15 wherein is included a first endplate fixedly attached to said end of said beam which is at or near said column, wherein a second endplate is attached to said column, and wherein said first and second endplates are attached to each other.

23. The structural joint of claim 15 wherein said connection means extend along said beam, between said beam and said russet plates, wherein said connection means extend beyond the end of said gusset plates, wherein said connection means are fastened to said beam for a distance commencing at a location at or near said column and extending beyond the end of said gusset plates, wherein said connection means are fixedly attached to said gusset plates from a location at or near said column, for a distance extending substantially to the end of said gusset plates.

24. The structural joint of claim 15 wherein said connection means extend along said column between said column and said side plates and beyond the end of said side plates a substantial distance, and wherein said connection means are bolted to said column between said column and said side plates and beyond the end of said side plates for said substantial distance.

25. The structural joint connection of claim 15 wherein said connection means comprise plate means extending along said flanges of said beam, wherein said fasteners comprises bolts and nuts, and wherein said fasteners fasten said connection means to said beam by said bolts and nuts fastening said plate means to said flanges of beam, said plate being fastened to said flange for substantially the distance said side plates extend along said beam, in the longitudinal direction of said beam.

26. A structural joint connection comprising a beam and a column, said beam comprised of a web connected between upper and lower flanges, two gusset plates attached to said column, on opposite sides of said column and in face-to-face relationship with respect to each other across said column, wherein said gusset plates have a length at least extending the width of said column and along the sides of said beam, wherein said gusset plates have a width extending along said column for at least the width of said beam, connection means attached to said gusset plates and to said beam, wherein said connection means, at least in part, are attached to said beam by being one or more of bolted or riveted thereto, for at least substantially the length said gusset plates extend along the sides of said beam.

27. The structural joint connection of claim 26 wherein said connection means further comprise vertical shear plates each welded to the web of said beam and each welded to a respective one of said gusset plates.

28. The structural joint connection of claim 26 wherein said connection means are one or more of bolted or riveted to said upper and lower flanges of said beam, and wherein said connection means are attached to said gusset plates by being welded thereto.

29. The structural joint connection of claim 26 wherein said connection means are attached to said beam by being one or more of bolted or riveted to said web of said beam.

30. The structural joint connection of claim 26 wherein said connection means are welded to said gusset plates, and wherein said connection means is one or more of bolted or riveted to said beam for a length extending substantially beyond the end of said gusset plates along said beam.

31. The structural joint connection of claim 26 wherein said connection means comprise plate means.

32. A structural joint connection comprising a beam and a column, said beam comprised of a web connected between upper and lower flanges, two gusset plates attached to said column, on opposite sides of said column and in face-to-face relationship with respect to each other, and extending along the sides of said beam, connection means attached between said gusset plates and said beam, wherein said connection means, at least in part, are attached to said beam by being one or more of bolted or riveted thereto, for at least substantially the length said gusset plates extend along the sides of said beam, and wherein said connection means comprise angle irons.

* * * * *